US010352091B2

(12) United States Patent
Briese et al.

(10) Patent No.: US 10,352,091 B2
(45) Date of Patent: Jul. 16, 2019

(54) APPARATUS AND METHOD OF SEALING AN IGU

(71) Applicant: GED Integrated Solutions, Inc., Twinsburg, OH (US)

(72) Inventors: William Briese, Hinckley, OH (US); John Grismer, Cuyahoga Falls, OH (US); Paul A. Hoefner, Parma, OH (US)

(73) Assignee: GED Integrated Solutions, Inc., Twinsburg, OH (US)

( * ) Notice: Subject to any disclaimer, the term of this patent is extended or adjusted under 35 U.S.C. 154(b) by 316 days.

(21) Appl. No.: 14/645,579

(22) Filed: Mar. 12, 2015

(65) Prior Publication Data

US 2015/0259970 A1 Sep. 17, 2015

Related U.S. Application Data

(60) Provisional application No. 61/951,571, filed on Mar. 12, 2014.

(51) Int. Cl.
*E06B 3/673* (2006.01)

(52) U.S. Cl.
CPC ..... *E06B 3/67391* (2013.01); *E06B 3/67347* (2013.01); *E06B 3/67386* (2013.01); *Y10T 156/1702* (2015.01)

(58) Field of Classification Search
CPC ..... E06B 3/67391; E06B 3/67347; E06B 3/67386; Y10T 156/1702
See application file for complete search history.

(56) References Cited

U.S. PATENT DOCUMENTS

| | | | | |
|---|---|---|---|---|
| 3,947,311 | A * | 3/1976 | Jarchow | E06B 3/67343 156/357 |
| 4,295,914 | A * | 10/1981 | Checko | E06B 3/67343 118/408 |
| 4,628,528 | A | 12/1986 | Bose et al. | |
| 5,650,029 | A * | 7/1997 | Lafond | E06B 3/67343 156/107 |
| 5,932,062 | A * | 8/1999 | Manser | B05C 5/0216 118/669 |
| 6,250,358 | B1 * | 6/2001 | Lafond | E06B 3/67343 156/107 |
| 6,630,028 | B2 | 10/2003 | Briese et al. | |
| 2012/0137608 | A1 * | 6/2012 | Plant | E06B 3/66314 52/204.593 |
| 2013/0333842 | A1 | 12/2013 | McGlinchy | |

OTHER PUBLICATIONS (Windsor Windows, Glossary of Terms, http://www.windsorwindows.com/knowledge-center/windows-and-doors-101/glossary; last viewed on Oct. 5, 2017.*

* cited by examiner

*Primary Examiner* — James Mellott
(74) *Attorney, Agent, or Firm* — Tarolli, Sundheim, Covell & Tummino LLP; John A. Yirga, Esq.

(57) ABSTRACT

An apparatus for sealing an insulating glass unit includes a frame for supporting first and second clamping arrangements. The clamping arrangements support the insulating glass unit during a sealing operation. First and second dispensing assemblies are connected to the frame and movable relative to the frame. Each first and second dispensing assembly includes a nozzle for controlled dispensing of a sealant along a prescribed portion of the supported insulating glass unit during the sealing operation.

20 Claims, 9 Drawing Sheets

(FILL RE-CHARGE CYLINDER)

( RETURN PISTON TO REFILL POSITION )

( DISPENSE SEALANT OUT NOZZLE )

APPARATUS AND METHOD OF SEALING AN IGU

CROSS REFERENCES TO RELATED APPLICATIONS

The following application claims priority under 35 U.S.C. § 119(e) to U.S. Provisional Patent Application Ser. No. 61/951,571 filed Mar. 12, 2014 entitled APPARATUS AND METHOD OF SEALING AN IGU. The above-identified application is incorporated herein by reference in its entirety for all purposes.

TECHNICAL FIELD

This disclosure relates in general to equipment used in the construction of insulating glass units and, more specifically, to a method and apparatus for sealing an insulating glass unit.

BACKGROUND

Construction of insulating glass units (hereinafter plural "IGUs" and singular "IGU") generally involves forming a spacer frame by roll-forming a flat metal strip, into an elongated hollow rectangular tube or "U" shaped channel. Generally, a desiccant material is placed within the rectangular tube or channel, and some provisions are made for the desiccant to come into fluid communication with or otherwise affect the interior space of the insulated glass unit. The elongated tube or channel is notched to allow the channel to be formed into a rectangular frame. Generally, a sealant is applied to the outer three sides of the spacer frame in order to bond a pair of glass panes to either opposite side of the spacer frame. Existing heated sealants include hot melts and dual seal equivalents (DSE). The pair of glass panes are positioned on the spacer frame to form a pre-pressed insulating glass unit. Generally, the pre-pressed insulating glass unit is passed through an IGU oven to melt or activate the sealant. The pre-pressed insulating glass unit is then passed through a press that applies pressure to the glass and sealant and compresses the IGU to a selected pressed unit thickness.

Manufacturers may produce IGUs having a variety of different glass types, different glass thicknesses and different overall IGU thicknesses. The amount of heat required to melt the sealant of an IGU varies with the type of glass used for each pane of the IGU. Thicker glass panes and glass panes having low-E coatings have lower transmittance (higher opacities) than a thinner or clear glass pane. (opacity is inversely proportional to transmittance). Less energy passes through a pane of an IGU having a high reflectance and low transmittance. As a result, more energy is required to heat the sealant of an IGU with panes that have higher reflectance and lower transmittance. For example, less energy is required to heat the sealant of an IGU with two panes of clear, single strength glass than is required to heat the sealant of an IGU with one pane of clear, double strength glass and one pane of low-E coated double strength glass.

Typically, manufacturers of insulating glass units reduce the speed at which the insulating glass units pass through the IGU oven to the speed required to heat the sealant of a "worst case" IGU. This slower speed increases the dosage of exposure. In addition to the line speed sacrificed, many of the IGU's are overheated at the surface, resulting in longer required cooling times, and more work in process.

Some manufacturers produce IGUs in small groups that correspond to a particular job or house. As a result, these manufacturers frequently adjust the spacing between rollers of the press to press IGUs having different thicknesses. The thickness of the IGU being pressed is typically entered manually. Other manufacturers batch larger groups of IGUs together by thickness to reduce the frequency at which spacing between the rollers of the press needs to be adjusted.

Typically, an IGU has a pre-drilled or punched aperture hole which is used to vent and balance the internal pressure of the IGU during the oven heating process. The aperture is also used to fill the IGU with gas to improve the insulation properties of the unit. Once the IOU is filled with gas, a rivet or fastener such as a screw is placed into the hole to form a first seal, then a hot sealant acting as a second seal is manually applied with a putty knife or trowel along the spacer frame perimeter by an operator.

Further discussion relating to the types of IGUs and methods and equipment used to fabricate IGUs is discussed in U.S. Patent Publication No. U.S. 2013/0333842 that published on Dec. 19, 2013 and was assigned to the assignee of the present disclosure. The above U.S. Patent Publication is incorporated herein by reference in its entirety.

SUMMARY

One example embodiment includes an apparatus for sealing an insulating glass unit having a frame for supporting first and second clamping arrangements. The clamping arrangements support the insulating glass unit during a sealing operation. First and second dispensing assemblies are connected to the frame and movable relative to the frame. Each first and second dispensing assembly includes a nozzle for controlled dispensing of a sealant along a prescribed portion of the supported insulating glass unit during the sealing operation.

In accordance with another embodiment an apparatus for sealing an insulating glass unit includes a frame for supporting first and second clamping arrangements. The clamping arrangements support the insulating glass unit during a sealing operation. First and second dispensing assemblies each includes a nozzle for dispensing a sealant along a prescribed portion of the supported insulating glass unit. A moving device connects each dispensing assembly to the frame for moving the dispensing assemblies relative to the frame. A controller connected to the first and second dispensing assemblies controls the dispensing of the sealant from the nozzles. The controller is connected to the moving devices for controlling relative movement between the dispensing assemblies and the frame during the sealing operation.

In accordance with another embodiment a method of sealing an insulating glass unit includes providing a frame for supporting first and second clamping arrangements that secure the insulating glass unit. First and second dispensing assemblies connected to the frame are positioned along a prescribed portion of the supported insulating glass unit. Movement of the first and second dispensing assemblies is controlled along the prescribed portion with a controller. Sealant is dispensed from the dispensing assemblies into the insulating glass unit in a controlled manner while the dispensing assemblies move along the prescribed portion.

While another example embodiment includes an apparatus for sealing an insulating glass unit having a frame for supporting first and second clamping arrangements. The clamping arrangements support the insulating glass unit during a sealing operation. First and second dispensing assemblies are connected to the frame and movable relative to the frame. Each first and second dispensing assembly includes a nozzle for controlled dispensing of a sealant along a prescribed portion of the supported insulating glass unit during the sealing operation. The apparatus also includes a sensing system comprising first and second sensors for monitoring and controlling the amount of sealant being dispense by the respective first and second dispensing assemblies.

BRIEF DESCRIPTION OF THE DRAWINGS

The foregoing and other features and advantages of the present disclosure will become-apparent to one skilled in the art to which the present invention relates upon consideration of the following description of the invention with reference to the accompanying drawings, wherein like reference numerals refer to like parts unless described otherwise throughout the drawings and in which.

DETAILED DESCRIPTION

Referring now to the figures generally wherein like numbered features shown therein refer to like elements throughout, unless otherwise noted. The present disclosure relates to equipment used in the construction of insulating glass units ("IGUs") and, more specifically, to a method and apparatus for sealing an insulating glass unit ("IGU").

Figure 2:
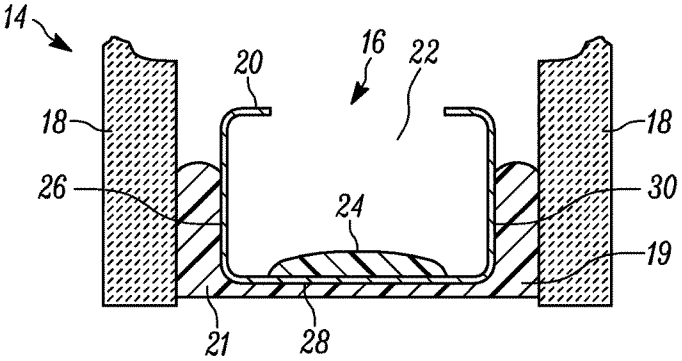
FIG. 2 is a sectional view taken across lines 2-2 of FIG. 1.
Figure 3:
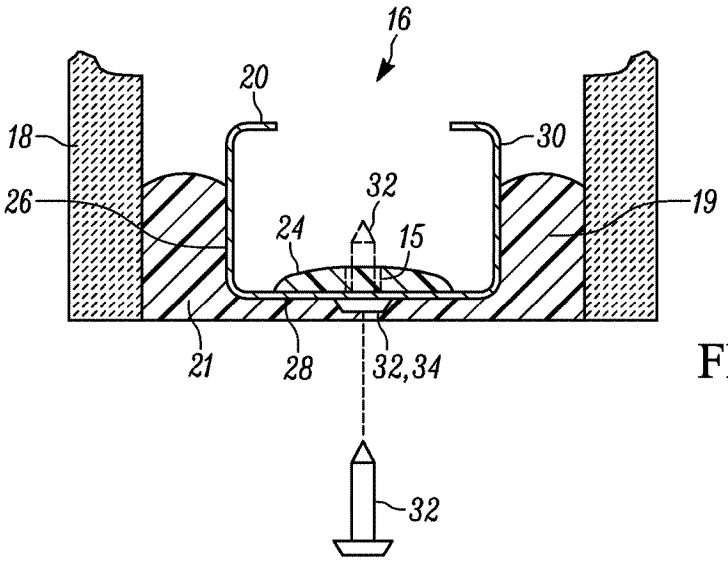
FIG. 3 is a sectional view of an insulating glass unit prior to pressing of the sealant to achieve the insulating glass unit of FIG. 2.
Figure 1:
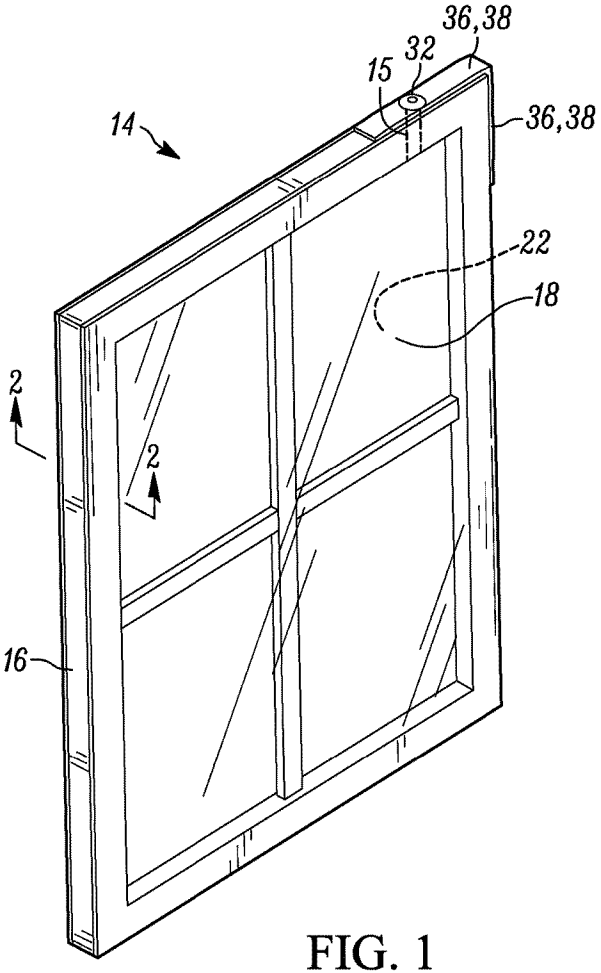
FIG. 1 is a perspective view of an insulating glass unit.

FIG. 1 illustrates one example of an insulating glass unit 14 (IGU). The IGU 14 is gas sealed using a scaling apparatus or assembly 10 first shown in FIG. 4. The IGU 14 comprises a spacer assembly 16 sandwiched between glass sheets or lites 18. Referring to FIGS. 2 and 3, the illustrated spacer assembly 16 includes a frame structure 20 (typically made from metal, such as steel or aluminum), a sealant material 19 for hermetically joining the frame to the lites 18 to form a first seal 21, and a closed space 22 within the IGU 14. A body of desiccant 24 is provided in the space 22. The IGU 14 illustrated by FIG. 1 is in condition for final assembly into a window or door frame, not illustrated, for installation into a house or a building. It is also contemplated that the disclosed apparatus may be used to construct an insulated window with panes bonded directly to sash elements of the window, rather than using an IGU that is constrained by the sash.

It should be readily apparent to those skilled in the art that the disclosed apparatus and method can be used with spacers other than the illustrated spacer. For example, a closed box shaped spacer, any rectangular or polygonal shaped spacer, any foam composite spacer or any alternative material can be used. It should also be apparent that the disclosed apparatus and method can be used in IGUs having any shape and size.

The glass lites 18 are constructed from any suitable or conventional glass. The glass lites 18 may be single strength or double strength and may include low emissivity coatings. The glass lites 18 on each side of the IGU 14 need not be identical, and in many applications different types of glass lites are used on opposite sides of the IGU. The illustrated lites 18 are rectangular, aligned with each other, and sized so that their peripheries are disposed just outwardly of the frame 20 outer periphery.

The spacer assembly 16 functions to maintain the lites 18 spaced apart from each other and to produce the hermetic insulating air space 22 between the lites. The frame 20 and sealant 19 cooperate to provide a structure which maintains the lites 18 properly assembled with the space 22 sealed from atmospheric moisture over long time periods during which, the insulating glass unit 14 is subjected to frequent significant thermal stresses. The desiccant body 24 serves to remove water vapor from air or other gases entrapped in the space 22 during construction of the IGU 14 and any moisture that migrates through the sealant 19 over time.

The sealant 19 both structurally adheres the lites 18 to the spacer assembly 16 and hermetically closes the space 22 against infiltration of air born water vapor from the atmosphere surrounding the IGU 14 and further keeps insulating gasses, such as argon, from diffusing out of the closed space. A variety of different sealants may be used to construct the IGU 14. Examples include hot melt sealants, dual seal equivalents (DSE), and modified polyurethane sealants. In the illustrated embodiment, the sealant 19 is extruded onto the frame 20. This is typically accomplished, for example, by passing an elongated frame (prior to bending into a rectangular frame) through a sealant application station, such as that disclosed by U.S. Pat. No. 4,628,528 or co-pending application Ser. No. 09/733,272, entitled "Controlled Adhesive Dispensing," assigned to the assignee of the present disclosure. Although a hot melt sealant is disclosed, other suitable or conventional substances (singly or in combination) for sealing and structurally carrying the unit components together may be employed without departing from the spirit of the present disclosure.

Referring to FIGS. 2 and 3, the illustrated frame 20 is constructed from a thin ribbon of metal, such as stainless steel, tin plated steel or aluminum. For example, 304 stainless steel having a thickness of 0.006-0.010 inches may be used. The ribbon is passed through forming rolls (not shown) to produce walls 26, 28, 30. In the illustrated embodiment, the desiccant 24 is attached to an inner surface of the frame wall 26. The desiccant 24 may be formed by a desiccating matrix in which a particulate desiccant is incorporated in a carrier material that is adhered to the frame 20. The carrier material may be silicon, hot melt, polyurethane or other suitable material. The desiccant 24 absorbs moisture from the surrounding atmosphere for a time after the desiccant is exposed to atmosphere. The desiccant 24 absorbs moisture from the atmosphere within the space 22 for some time after the IOU 14 is fabricated. This assures that condensation within the IGU 14 does not occur. In the illustrated embodiment, the desiccant 24 is extruded onto the frame 20.

To form an IGU 14 the lites 18 are placed on the spacer assembly 16. The IGU 14 is heated and pressed together to bond the lites 18 and the spacer assembly 16 together. Once the IGU frame has been pressed, an aperture 15 is drilled or punched along one end of the frame structure 20 through the first seal 21 and sealant 19, as illustrated in FIGS. 1 and 3. In an alternative example embodiment, the aperture 15 may be drilled or punched into the frame 20 before the sides 26, 28, and 30 are formed or before it is formed into a rectangular frame. The aperture 15 is used to fill the IGU 14 with gas to improve the insulation properties or quality of the unit. Once the IGU 14 is filled with gas, a rivet or fastener 32, such as a screw, is placed into the aperture 15 as a primary seal 34. A hot sealant 36 acting as a second or outer gas seal 38 is then automatically applied by a method and the assembly 10 as further described below.

Figure 12:
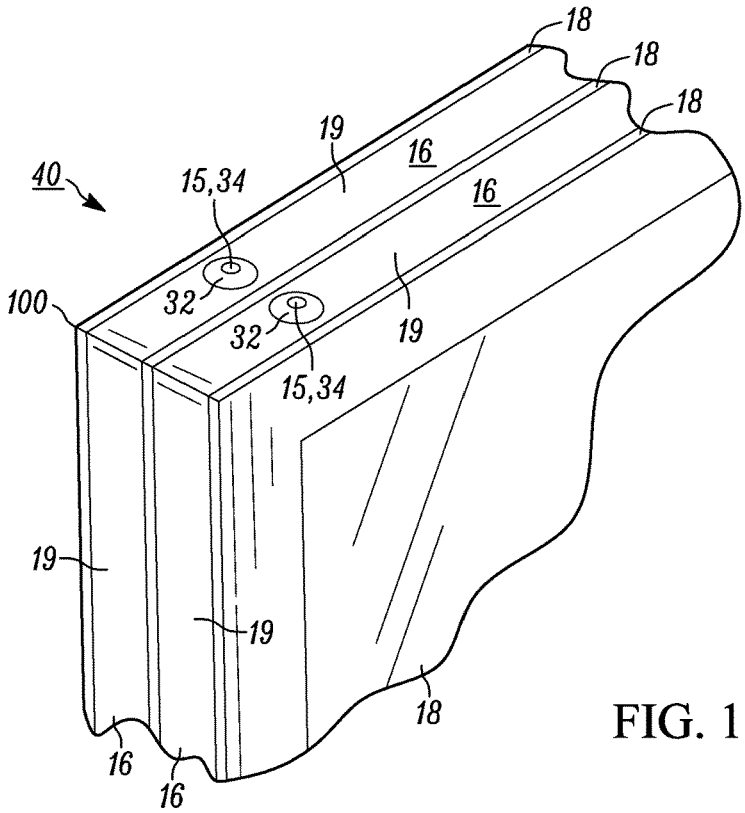
FIG. 12 is a triple pane IGU constructed in accordance with one example embodiment of the present disclosure.

While the current example embodiment illustrates an IGU 14 comprising a double pane, i.e. dual lites 18, one lite on each side of the frame 20, one or more apertures 15 can exists on an IGU, for example in a triple pane IGU 40, as illustrated in FIG. 12. The triple pane IGU 40 and both apertures 15 and second seal 34 are sealed with the hot sealant 36 forming the third or outer gas seal 38 by the assembly 10 without departing from the spirit and scope of the present disclosure.

In one example embodiment, the hot sealant 36 is made from similar material as the first sealing material 21 of the sealant 19, namely hot melt sealants, dual seal equivalents (DSE), and modified polyurethane sealants. The assembly 10 extrudes the sealant 36 such that it bonds with the sealant 19. This is further achieved by elevating the sealant 36 temperature as it is applied along the IGU 14/40. In yet another embodiment, the sealant 36 is made from a material that cures under natural or ambient conditions without a need for a subsequent heating process.

Figure 13:
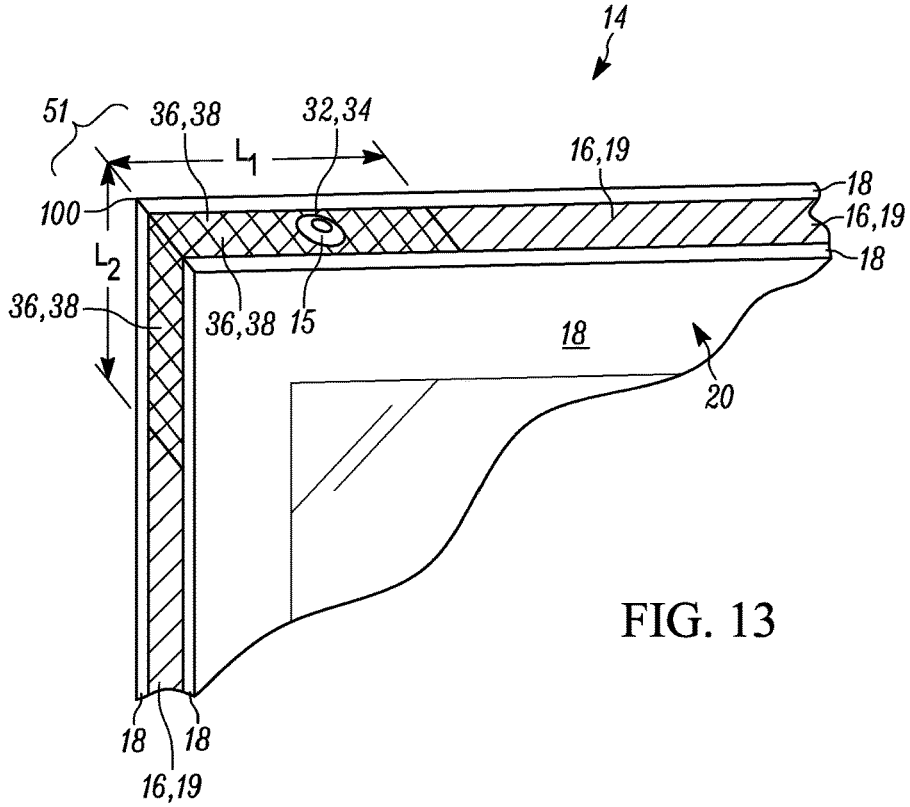
FIG. 13 is an IGU constructed with a third seal or outer gas sealant adhered to a prescribed portion of the spacer frame.

FIGS. 4-11 illustrate an assembly 10 for automatically applying a prescribed amount of the sealant 36 along a select portion 51 (defined by dispensing paths $L_1$ and $L_2$ in FIG. 13) of the IGU 14/40 to form the third or outer gas seal 38. The seal 38 extends over the aperture 15 and the fastener 32 to form a sealing, leak-proof cover with the closed space 22 of the IGU 14/40. The sealant 36 is applied along a designated corner 100 of the IGU 14/40. The designated corner 100 is defined by one of the four corners of the IGU 14/40 that includes both the dispensing path $L_1$ of the side having the aperture 15 and its adjacent dispensing path $L_2$.

In the illustrated example embodiment, the sealing assembly 10 includes first and second clamping arrangements 44, 46 supported between front and rear frame members 48, 50 collectively defining a frame. The sealing assembly 10 further includes first and second dispensing head assemblies 52 and 54 corresponding with the clamping arrangements 44, 46 and used to apply the sealant 36.

In one example embodiment, the assembly 10 is supported by a manipulator or bridge crane (both not shown) so that the apparatus can be easily moved by an operator into a desired position for selecting one of several IGU 14/40 assemblies. In another example embodiment, the apparatus 10 is configured with a robotic positioning system or other automated positioning system (not shown).

Figure 9:
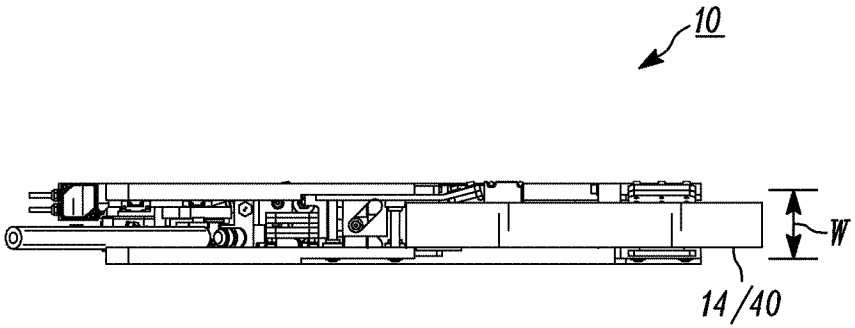
FIG. 9 is a bottom plan view of FIG. 4.
Figure 10:
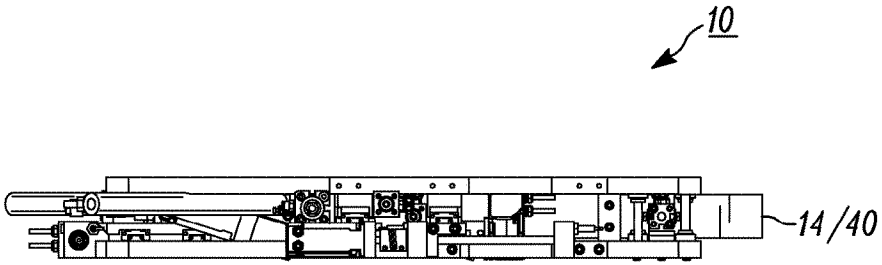
FIG. 10 is a top plan view of FIG. 4.
Figure 8:
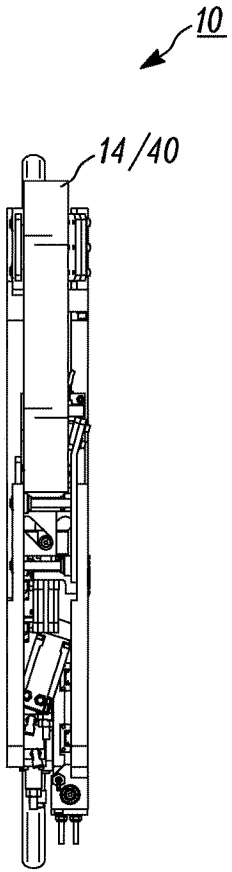
FIG. 8 is a right side elevation view of FIG. 4.
Figure 7:
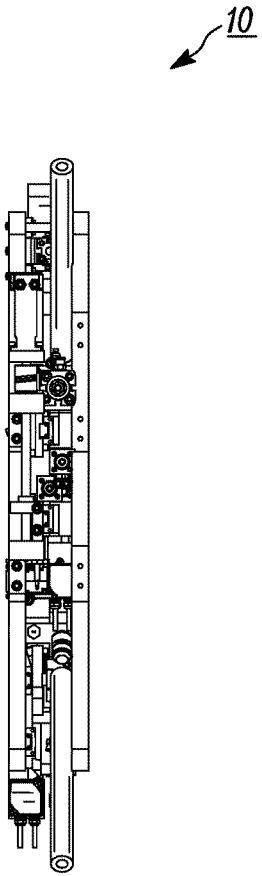
FIG. 7 is a left side elevation view of FIG. 4.
Figure 11:
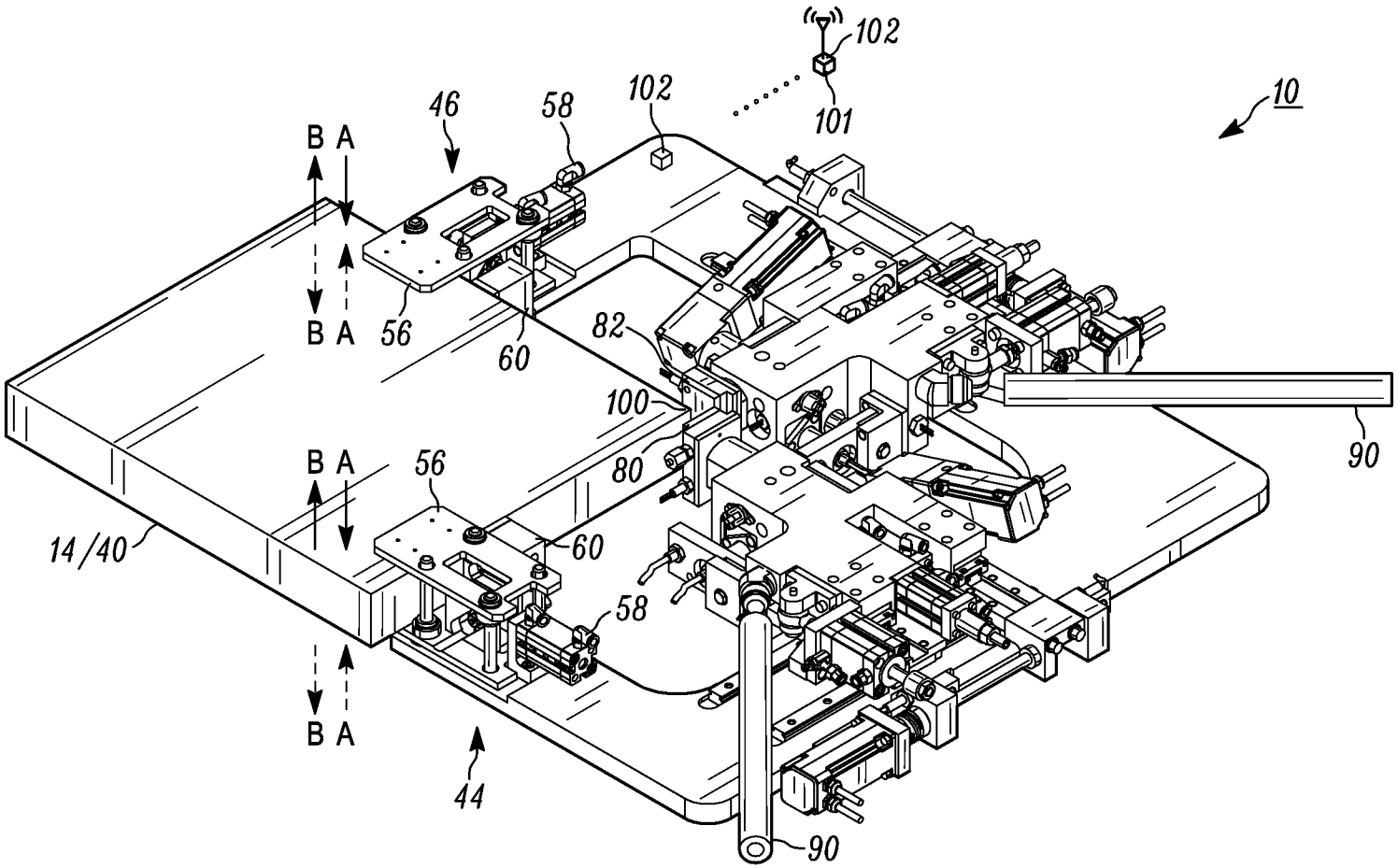
FIG. 11 is a rear perspective view of FIG. 4 with a rear frame member removed.
Figure 14:
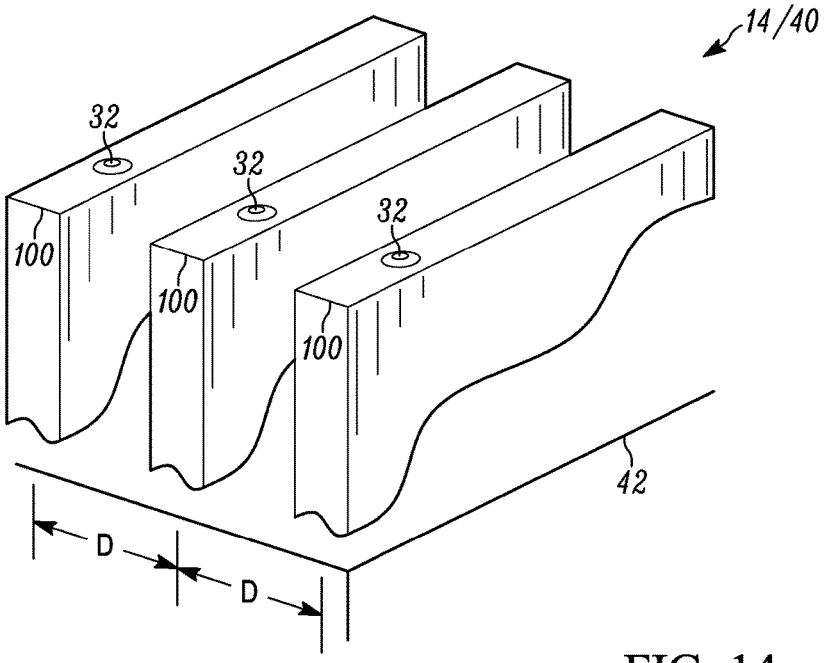
FIG. 14 is a rack supporting a plurality of IGUs to be received by the sealing apparatus in accordance to one example embodiment of the present disclosure.

In FIG. 14, a plurality of IGUs 14/40 spaced apart a distance D in a cart or rack 42 next to a station are in reach of the manipulator or crane supporting the assembly 10. In one example embodiment, the distance D is only a few inches, thus the width of the apparatus W, as shown in FIG. 9, is small enough to allow the sealing assembly 10 to pass between the IGU's 14/40 and the rack 42.

The IGUs 14/40 in the illustrated example embodiment of FIG. 14 are such that the designated corner 100 is arranged outward in the rack 42 for each IGU. This allows the sealing assembly 10 to be manipulated by an operator to select an IGU 14/40 in the rack 42 such that the designated corner 100 is always located between the first and second clamping arrangements 44, 46 and between the frame members 48, 50 in the home position illustrated in FIG. 4.

Figure 4:
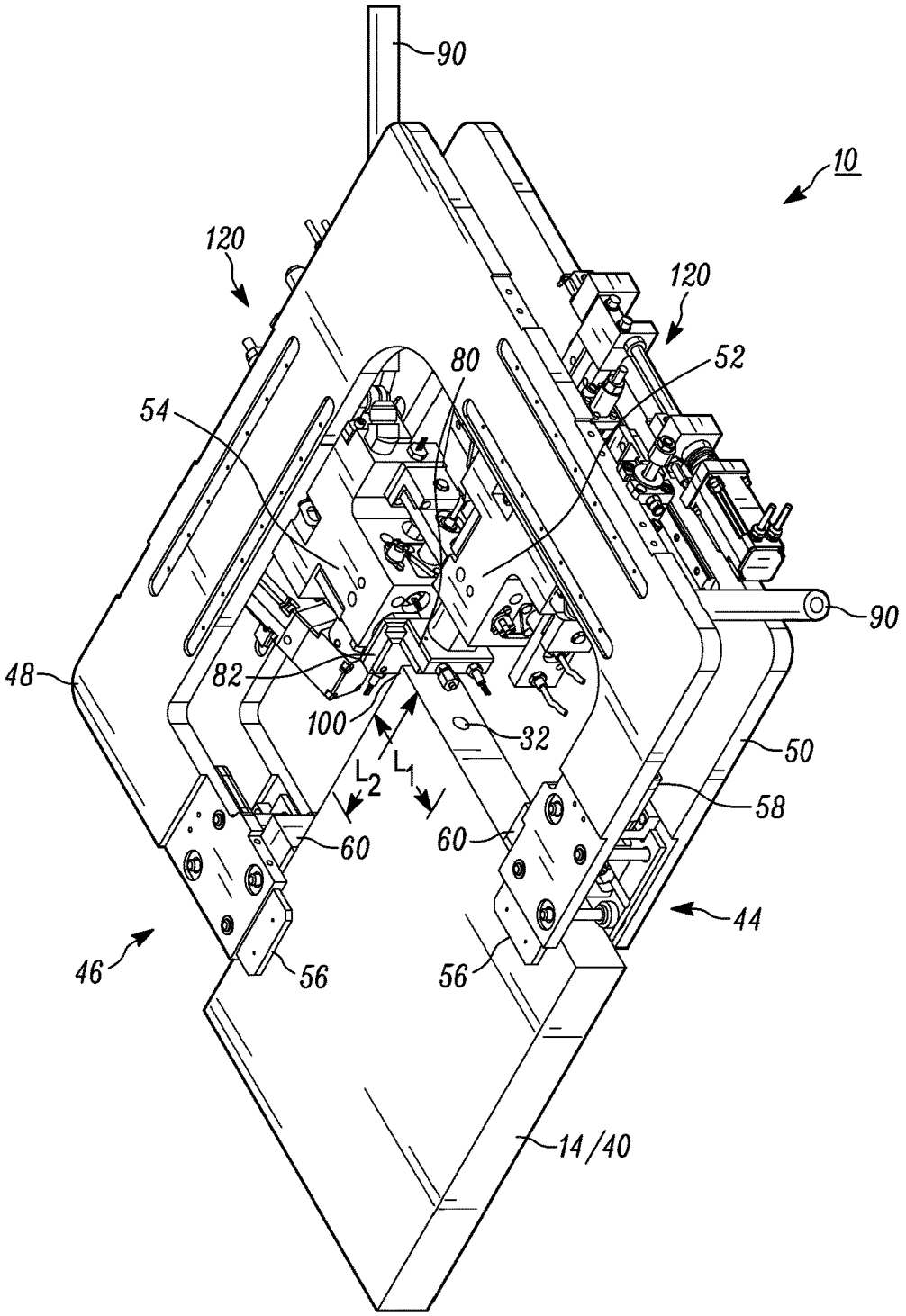
FIG. 4 a front perspective view of a sealing apparatus or assembly constructed in accordance with one example embodiment of the present disclosure.
Figure 6:
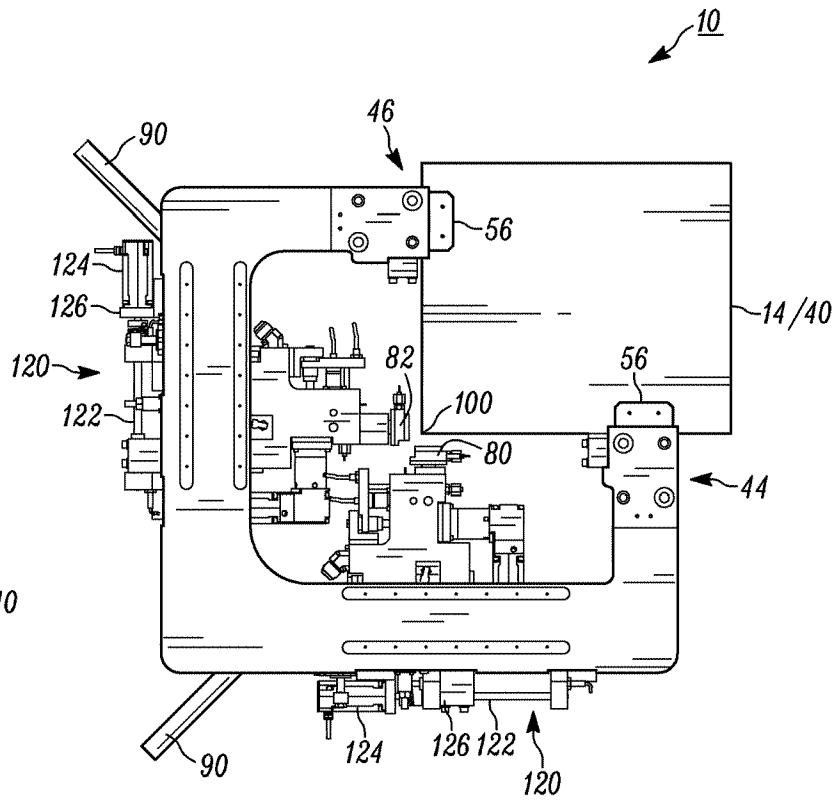
FIG. 6 is a rear elevation view of FIG. 4.
Figure 5:
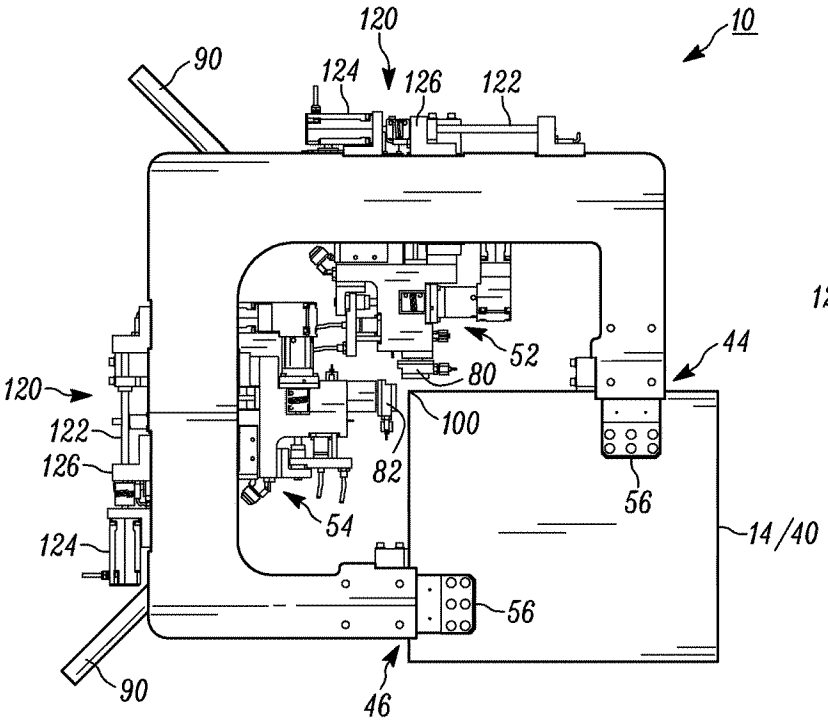
FIG. 5 is a front elevation view of FIG. 4.

Once the IGU 14/40 is located by the operator between the frame members 48, 50 such that the designated corner 100 is in the home position of FIG. 4, the clamping arrangements 44, 46 expand and retract onto the IGU, engaging the IGU with fingers 56 extending from the frame members. In the illustrated example embodiment of FIG. 11, cylinders 58 retract the fingers 56 toward the frame 20 in the direction of arrow A to hold the IGU 14/40. The cylinders 58 expand the fingers 56 away from the frame 20 in the direction of arrow B to release the IGU 14/40.

In the illustrated example embodiment, the cylinders 58 are pneumatic cylinders fixedly attached between the frame members 48, 50. It should be appreciated that other clamping means for selectively securing the IOU 14/40 could be used without departing from the spirit and scope of the present disclosure. The clamping arrangements 44, 46 should be gentle enough to not fracture the lites 18 located on both sides of the frame structure 20, yet strong enough to support the IGU 14/40 during the application of the sealant 36. In one example embodiment, the clamping arrangements 44, 46 are fitted with a scale measurement system (not shown) to detect the width of the IGU 14/40 being clamped. This width measurement is correlated with a predetermined set of parameters or recipe 101 (see FIG. 11) assigned to that IGU 14/40 size, which assigns feed rates, dispensing rates, and the like to the system 10.

More specifically, the recipe 101 is stored or accessed by a programmable controller 102 fixed on the sealing assembly 10 (FIG. 11) or remotely located. The recipe 101 will control the amount of sealant 36 dispensed by each dispensing head assembly 52, 54. The amount can be the same or different between head assemblies 52, 54 or vary over the length of the dispensing paths $L_1$ and/or $L_2$ based on a program in the recipe 101 relating to the width, size, and particular application of the IGU 14/40 being processed by the sealing assembly 10. The recipe 101 can be retrieved from an external database or the controller 102.

Figure 17:
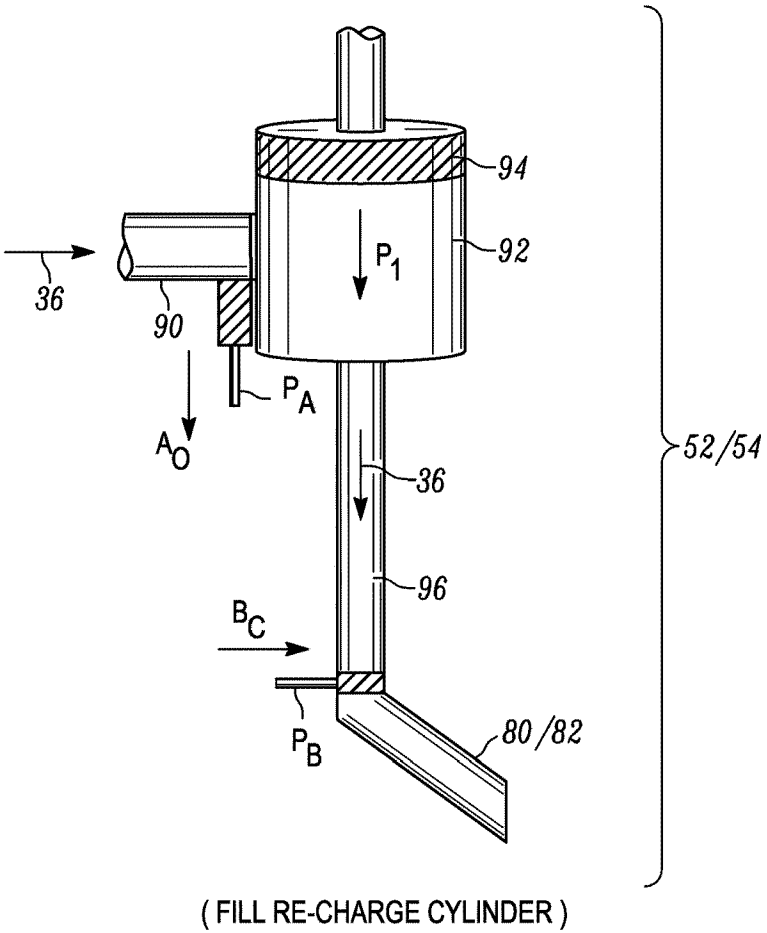
FIG. 17 is a first schematic illustration of a dispensing assembly in a pre-charge filing position.
Figure 19:
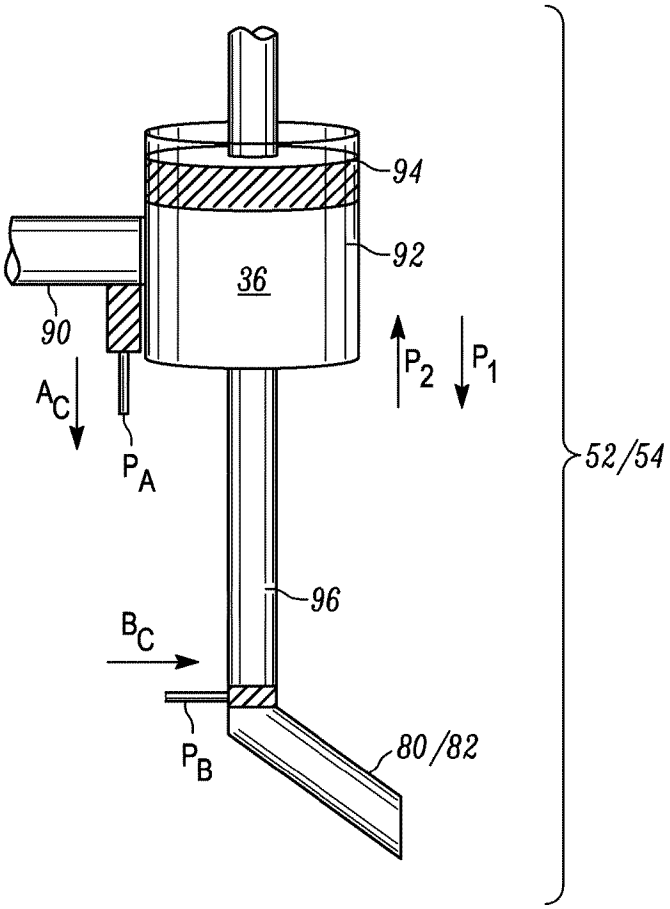
FIG. 19 is a third schematic illustration of a dispensing assembly in a return position.
Figure 18:
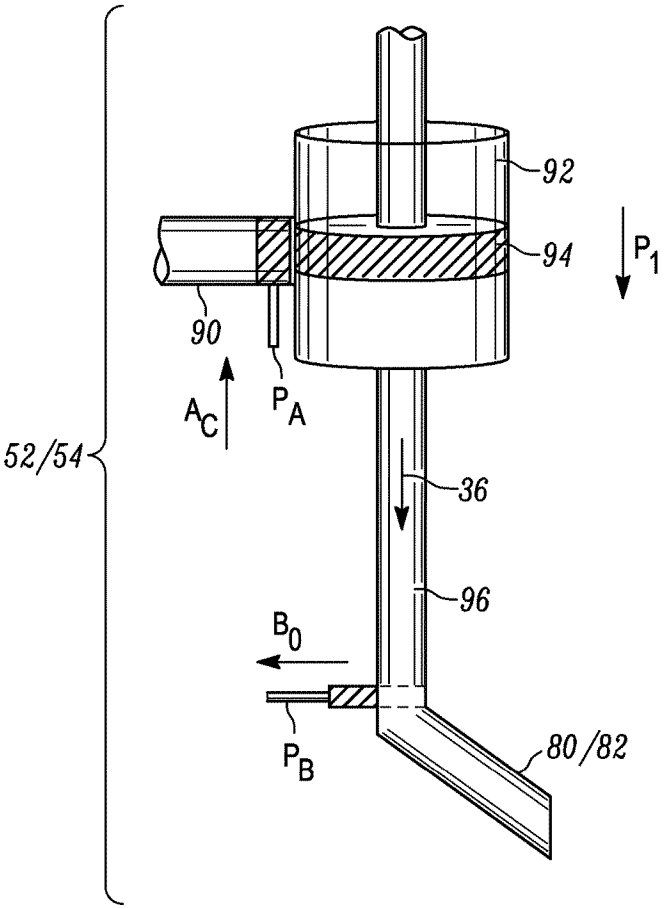
FIG. 18 is a second schematic illustration of a dispensing assembly in a sealant dispensing position.

FIGS. 4, 11, and 17-19 illustrate two dispensing assemblies 52, 54 for dispensing sealant 36 onto the IGU 14/40. The dispensing assemblies 52, 54 receive the sealant 36 from supply tubes 90. The supply tubes 90 are coupled to a bulk drum having an unloading pump system (not shown) or some other feeding system as would be appreciated by those of ordinary skill in the art. In FIGS. 17-19 the dispensing assemblies 52, 54 are shown in more detail during the dispensing operation, as the supply tubes 90 feed into a cylinder 92 that includes a pneumatic piston 94. A pair of shutoff valves $P_A$, $P_B$, such as solenoid valves, cooperate with the supply tubes 90, cylinder 92, and a stage tube 96 to regulate the storage and flow of sealant 36 through the dispensing assemblies 52, 54. The pneumatic piston 94 advances in a direction $P_1$ to apply controlled pressure and feed rate to the sealant 36 through the first stage tube 96 out nozzles 80, 82. During the dispensing operation, the valve $P_A$ is closed, as shown in the arrow $A_C$, so that that no sealant returns to the supply tube 90 and all the sealant 36 preloaded into the cylinder 92 is advanced by the piston 94 out the stage tube 96 and to the nozzle 80, 82.

In FIG. 17, with the valve $P_A$ opened (as shown in the direction of arrow $A_O$) the piston 94 is fully retracted to a designated location based on the recipe 101 and slowly advances in the direction $P_1$. Once the sealant 36 completely fills the cylinder 92 through to the first stage tube 96 the shutoff valve $P_B$ is closed (as shown in the direction of arrow $B_C$) to prevent sealant from exiting the nozzles 80, 82. This allows the cylinder 92 to be set at a pre-charge amount with the amount of sealant 36 needed for a pass along a side of a designated corner 100 of an IGU 14/40 with a size known by the controller 102.

Figure 15A:
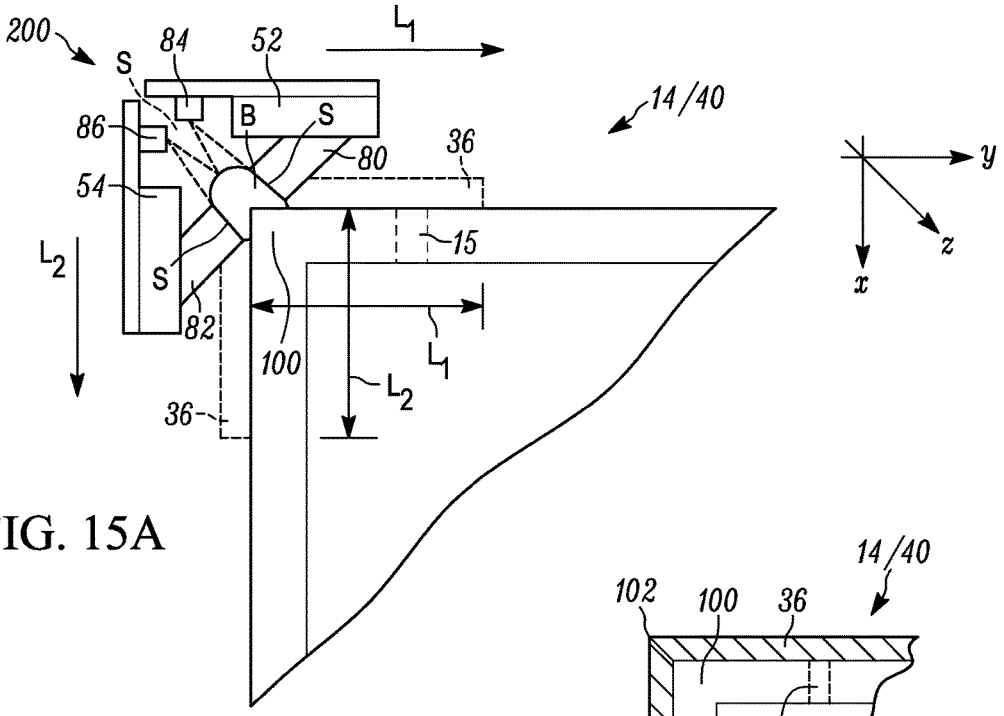
FIG. 15A illustrates dispensing assemblies advancing away from a designated corner of an IGU while applying sealant being monitored by a sensing system in accordance with one example embodiment of the present disclosure.
Figure 16:
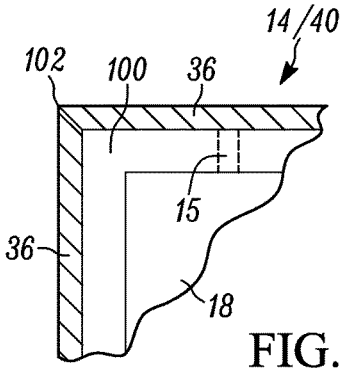
FIG. 16 is an IGU after receiving sealant at a designated corner of an IGU by the sealant apparatus.
Figure 15B:
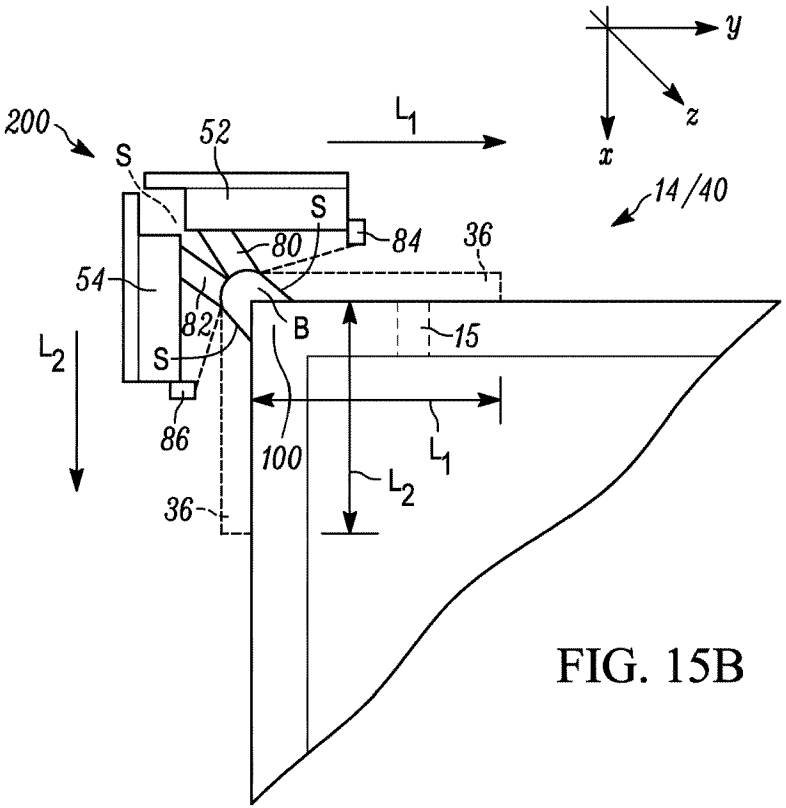
FIG. 15B illustrates dispensing assemblies advancing away from a designated corner of an IGU while applying sealant being monitored by a sensing system in accordance with another example embodiment of the present disclosure.

In FIG. 18, the piston 94 is further advanced to the precharge location. The shutoff valve $P_A$ is closed in the direction of the arrow $A_C$. Once the pre-charge depth is set, the first shutoff valve $P_B$ is opened in the direction of the arrow $B_O$. The piston 94 advances, forcing sealant 36 at a controlled rate out of the nozzles 80, 82 as the head assemblies 52, 54 are translated at a controlled rate by the recipe 101 along a travel slide arrangement 120 from the designated corner 100 outward of the IGU 14/40 and along the dispensing paths $L_1$ or $L_2$ (as shown in FIGS. 15A and 15B). The travel slide arrangement 120 (see FIGS. 5-6) is secured to one or both frame members 48, 50 and includes a rail 122 movably coupled to each dispensing head assembly 52, 54 to translate the respective nozzle 80, 82 at a prescribed speed/feed rate by the recipe 101 along the corresponding dispensing paths $L_1$ and $L_2$.

Each travel slide arrangement 120 further includes a moving device 124 having a fixture 126 moveably coupled to the rail 122 and fixedly attached to the dispensing assembly 52, 54. In one example embodiment, the moving device 124 is a servo motor, screw drive or pneumatic cylinder in which the speed is controlled by the recipe 101 in the controller 102. It should be appreciated that the recipe 101 can control the rate of movement of the dispensing assemblies 52, 54 and respective nozzles 80, 82 through the moving device 124 along dispensing paths $L_1$ and $L_2$, and to their return or home positions starting at the designated corner 101 of the IGU 14/40.

The nozzles 80, 82 dispense sealant 36 by the downward movement of the piston 94 in the direction of the arrow $P_1$. As such, the prescribed amount of sealant 36 is applied along the dispensing paths $L_1$ and $L_2$ while the slide arrangements 120 move the head assemblies 52, 54 along respective dispensing paths of the IGU 14/40. When the nozzles 80, 82 reach the end of the corresponding dispensing path $L_1$, $L_2$, the shut off valve $P_B$ closes in the direction of arrow $B_C$ while the piston 94 returns to the home position illustrated in FIG. 19. At such point, the moving device 120 returns both dispensing assemblies 52, 54 to the home or start position illustrated in FIG. 15A.

In one example embodiment, the dispensing head assemblies 52, 54 include a floating mechanism to allow the nozzles 80, 82 to remain in constant contact along the end of the IGU 14/40 to accommodate alignment of the sealant along the dispensing paths $L_1$ and $L_2$. As well, the construction/configuration of the nozzles 80, 82 spill out. The recipe 101 progresses the nozzles 80, 82 along the dispensing paths $L_1$ and $L_2$ at a prescribed rate so that the sealant 36 will not trap air and allows for maximum bonding with the IGU 14/40. In one example embodiment, the nozzles 80, 82 are commercially made by GED Integrated Solutions, Inc., the assignee of the present application.

In another example embodiment, the dispensing assemblies 52, 54 will sense the location of the aperture 15 along the designated corner 100 and apply more sealant 36 from the nozzle 80 or 82 that passes over the aperture. In yet another example embodiment, the amount of material, pressure, and/or temperature of the sealant 36 is provided from a feedback loop 103 to the controller 102 to alter the recipe 101 with regards to pressure, flow rate, travel rate of the moving device 124, and/or temperature of the sealant from either nozzle 80, 82.

In the illustrated example embodiment of FIG. 15A, it is shown how a starting corner 105 of the sealant 36 is formed by both nozzles 80, 82, resulting in each line of sealant over the dispensing paths $L_1$ and $L_2$ to provide back pressures to the other line of sealant. This supports the pressure of the sealant 36 excreted from each nozzle 80, 82 at the designated corner 100, which advantageously provides a stronger and higher quality seal over the IGU 14/40. Stated another way, holding the nozzles 80, 82 together as they start dispensing at the designated corner 100 for a pre-determined time after the dispensing starts (such as a dwell for a few seconds) maintains pressure in the corner and prevents the sealant 36 from spilling out of the back of the nozzle tips, thereby assuring a proper seal fill in the corner.

The automated method and apparatus provided by the sealing assembly 10 provide several advantages over the manual application of sealant 36 over the aperture 15. First, unlike manual applications, the sealant 36 delivered by the system 10 is applied with a repeatable, consistently prescribed amount from the first and second dispensing head assemblies 52, 54. The prescribed amount can be changed by the recipe 101. Within the external database or controller 102, the exact IGU 14/40 is known by a production schedule loaded into the controller or database, barcode information provided to the controller or database, or by measurements taken and matching of the dimensions of the IGU 14/40 to match that of IGUs within the recipe 101.

Second, the amount of pressure used to apply the sealant 36 along the IGU 14/40 from the head assemblies 52, 54 is consistent and repeatable. The apparatus system 10 advantageously maintains adequate pressure between the face/end of each nozzle 80, 82 and the sealant 36 material so that the sealant properly flows into the channel along the dispensing paths $L_1$ and $L_2$ and displaces any air that might become trapped between the IGU sealant 19 and the sealant 36 added by the system 10.

The pressure is set/maintained by the repeatable locating of the IGU 14/40 within the assembly 10 by: 1) engaging stops 60 on the clamping arrangements 42, 44 so that the depth into the assembly 10 is repeatable before the fingers 56 are clamped, 2) the proximity of the nozzles 80, 82 to the designated corner 100 of the IGU when the sealant is being applied, 3) the speed in which the sealant 36 is applied from the nozzles, and 4) the rate of speed the nozzles move along the select portion 51 of the IGU during dispensing. These pressure controls are also controlled by the programmed recipe 101 in the controller 102 based on the type, size, and application of the IGU 14/40.

Third, the time (rate) in which the sealant 36 is applied/dispensed from the nozzles 80, 82 is consistent along with the temperature. Both the time and the temperature are controlled by the program recipe 101 in the controller 102, making each application repeatable. For example, if the dispensing rate from the nozzle 80, 82 is too fast, there will not be sufficient time for the sealant 36 to melt into (i.e. weld with) the primary sealant 19 located on the spacer assembly 16. The apparatus system 10 advantageously maintains a consistent dispensing rate in combination with the feed rate of the moving device 124 to accomplish proper material interface bonding. In other words, for each particular recipe 101, the system 10 reliably dispenses the sealant 36 from the nozzles 80, 82 at the specific (e.g., constant) rate and moves the dispensing assemblies 52, 54 at the specific (e.g., constant) feed rate. In manual operations, this process is frequently performed too fast, and proper bonding between sealants is not realized.

Finally, the cycle time is constant, allowing for a projected consistent number of IOUs 14/40 to be processed by the assembly 10 each day. In one example embodiment, the cycle time is 10 seconds from the time the IGU 14/40 is processed. All of the above advantages of the assembly 10 eliminate the defects commonly associated with manual sealant application to the IGUs 14/40.

Illustrated in FIGS. 15A and 15B is a sensing system 200 constructed in accordance with another example embodiment of the present disclosure. The sensing system 200 provides analog sensors for controlling the amount of sealant positioned onto the spacer frame 20. This avoids the need of a recipe 101 that is generated by an operator selecting a part number or scanning a barcode comprising a part number that generates a program on how much sealant 36 to dispense for a particular spacer assembly 16. As well, the sensing system 200 avoids the need to measure the thickness of the glass 18, spacer frame 20, and overall IGU spacer frame assembly 16 stackup and correlating such measurement to a part number that generates a program on how much sealant 36 to dispense for a particular spacer assembly 16.

The sensing system 200 instead monitors the amount of sealant 36 and in particular, the size of the bead "B" formed by the sealant being dispensed by the nozzles 80 and 82 as they move independently along dispensing paths $L_1$ and $L_2$. As the size of the bead B is being measured, feedback as to size is being analyzed by the controller 102 on how much more, less, or to maintain the amount of sealant 36 being dispensed as the nozzles 80, 82 move along dispensing paths $L_1$ and $L_2$ or alternatively increase or decrease the speed of travel by the nozzles 80 and 82, which is an alternative way to influence the size of the bead B.

The sensing system 200 comprises analog sensors 84 and 86 mounted to or on fixture near respective nozzle 80, 82, respectively. The sensors 84 and 86 project measurement scans "S" that sizes the bead B as it is formed throughout the dispensing paths $L_1$ and $L_2$. In one example embodiment, the analog sensors 84, 86 comprise a laser scanner, infrared scanner, vision system, camera, or the like. In another example embodiment, the sensors 84, 86 are infrared sensors that advantageously measure the "hot melt" or sealant 36, the infrared sensors being manufactured by Rayteck under part number M130LTS. In yet another example embodiment, the sensors 84, 86 are laser sensors manufactured by Banner under part number LE550IQ. The specification sheets for both of the above part numbers are incorporated herein by reference.

The sensing system 200 allows the cavity to be filled to a prescribed level without knowing the part number of the spacer assembly 16 or its overall thickness. Instead, the sensing system 200 measures the bead B, until a prescribed size in the bead is reached and sensed by the respective sensors 84, 86.

During operation, the heads 52, 54 are not moved until a bead B of sufficient size is reached. That is, the nozzles 80 and 82 begin to dispense sealant 36 until the respective window cavities are filled and a sufficient amount of sealant 36 is provided to form a bead B within the programmed or prescribed limits are met in the controller 102 as scanned by the sensors 84, 86. Once the prescribed bead size is reached, the respective nozzle 80 or 82 moves along its respective dispensing path $L_1$ or $L_2$ at a controlled speed, that is only, advancing along the path when the proper bead B size has been reached. Should the bead B size disappear or be undersized, the travel of the respective nozzle and head slows down, stops or alternatively the controller 102 forces the nozzle to dispense more material, or any combination thereof.

In one example embodiment, the bead B is scanned and analyzed in all three dimensions, namely X, Y, and Z as illustrated in FIGS. 15A and 15B in order to obtain the prescribed amount for advance of the respective nozzle 80, 82. It should be appreciated that any one, two, or all three dimensions are measured in analyzing the prescribed bead B size against the prescribed threshold. The sensors 80, 82 provide smart dimensions to the controller 102, eliminating problems created by different cavity sizes or cavity depths, material thickness, and assumptions that all parts are constructed the same because a common part number is shared. In FIG. 15A, the sensors 84, 86 trail the bead B as the nozzles 80, 82 are directed transversely toward the selected corner of the IGU. While in FIG. 15B, the sensors 84, 86 lead the bead B as the nozzles 80, 82 are directed transversely away from the selected corner of the IGU.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

What is claimed is:

1. A method of sealing an insulating glass unit comprising:

supporting an insulating glass unit with a clamping arrangement that engages and maintains the insulating glass unit in a fixed and stationary position during sealant dispensing, the insulating glass unit having two glass lites spaced apart by a spacer frame;

positioning first and second sealant dispensing assemblies at first and second initial positions near a corner region of the insulating glass unit where first and second outwardly facing wall surfaces of the insulating glass unit meet;

maintaining the first and second dispensing assemblies at the first and second initial positions while dispensing sealant from the first and second dispensing assemblies onto the insulating glass unit to cause the sealant dispensed from the first and second dispensing assemblies to form a sealant bead;

moving the first and second dispensing assemblies away from the first and second initial positions while dispensing sealant onto the first and second outwardly facing wall surfaces of the insulating glass unit; and sensing an amount of the sealant accumulated on the outwardly facing wall surfaces of the supported insulating glass unit from the first and second dispensing assemblies and further wherein the movement of the first and second dispensing assemblies or a rate at which the sealant is dispensed is controlled based on said sensing.

2. The method of claim 1 wherein two sensors provide a signal related to accumulated sealant wherein a first sensor monitors an amount of sealant dispensed from the first dispensing assembly and a second sensor monitors an amount of sealant dispensed from the second dispensing assembly.

3. The method of claim 2 wherein the first sensor is mounted to the first dispensing assembly and the second sensor is mounted to the second dispensing assembly.

4. The method of claim 1 wherein the sensing an amount of sealant comprises sensing a bead size of sealant bead dispensed onto the insulating glass unit by the first and second dispensing assemblies while positioned at the first and second initial positions.

5. The method of claim 4 wherein once a prescribed bead size is sensed by one sensor of said first and second sensors, the dispensing assembly to which said one sensor is mounted is moved to continue dispensing of sealant.

6. The method of claim 1 wherein the dispensing assemblies dispense sealant until the outwardly facing wall surface is covered with a sufficient amount of sealant to form a bead having a prescribed bead size.

7. The method of claim 6 wherein once the prescribed bead size has been reached the respective dispensing assembly moves away from an initial position for forming said bead and moves along a respective dispensing path at a controlled speed to control bead size along said dispensing path.

8. The method of claim 7 wherein the dispensing assemblies comprise first and second drives for moving the associated first and second dispensing assemblies along respective first and second paths and in response to said sensing, a rate of movement along said first and second paths is controlled to control bead size.

9. The method of claim 8 wherein the controller coupled to the first and second drives adjusts movement of said first and second dispensing assemblies along the first and second paths and the controller can slow down, stop, or cause the first and second dispensing assemblies to dispense more material in response to the sensing of bead size.

10. A method of sealing an insulating glass unit comprising:

supporting an insulating glass unit having first and second outwardly facing wall surfaces which meet to form a corner with a clamping arrangement that maintains the insulating glass unit in a fixed and stationary position during sealant dispensing;

positioning a first dispensing assembly in a first initial position to dispense sealant against one of the two outwardly facing wall surfaces at a region of the corner;

positioning a second dispensing assembly in a second initial position to dispense sealant against a second of the two outwardly facing wall surfaces at a region of the corner;

without moving the first and second dispensing assemblies from the first and second initial positions, dispensing sealant from the first and the second dispensing assemblies to cause sealant dispensed from the first and second dispensing assemblies to come in contact at a region of the corner to form a sealant bead;

moving the first and second dispensing assemblies away from the first and second initial positions while dispensing sealant onto said first and second outwardly facing walls; and controlling relative movement of the first and second dispensing assemblies in relation to the insulating glass unit or a rate at which sealant is dispensed by said first and second dispensing assemblies.

11. The method of claim 10 additionally comprising sensing an amount of sealant with two sensors to provide a signal related to accumulated sealant.

12. The method of claim 11 wherein a first sensor monitors an amount of sealant dispensed from said first dispensing assembly and a second sensor monitors an amount of sealant dispensed from said second dispensing assembly.

13. The method of claim 12 wherein the first sensor is mounted to the first dispensing assembly and the second sensor is mounted to the second dispensing assembly.

14. The method of claim 12 wherein the sensing an amount of sealant comprises sensing a prescribed bead size by one sensor of said first and second sensors, and the controlling relative movement of the first and second dispensing assemblies comprises moving a dispensing assembly on which said one sensor is mounted to continue dispensing of sealant.

15. The method of claim 10 wherein responsive to sensing at least one of an aperture and the corner where the first and second outwardly facing walls meet, a dispensing assembly of the first and second dispensing assemblies over the aperture or designated corner dispenses an amount of sealant greater than an amount of sealant dispensed when at least one of the aperture or designated corner are not sensed.

16. The method of claim 10 wherein a respective one of the one first and second dispensing assemblies dispense sealant until a surface of the outwardly facing edge is covered with a sufficient amount of sealant to form a bead having a prescribed bead size.

17. The method of claim 16 wherein once the prescribed bead size has been reached the respective one dispensing assembly moves away from an initial position for forming said bead and moves along a respective dispensing path along the outwardly facing edge at a controlled speed to control bead size along said dispensing path.

18. The method of claim 10 wherein the first dispensing assembly comprises a first drive and the second dispensing assembly of the one or more dispensing assembly comprises a second drive for moving the first and second dispensing assemblies along respective first and second paths and based upon the amount of sealant sensed.

19. The method of claim 18 wherein the controlling relative movement of the first and second dispensing assemblies comprises controlling a rate of movement along said first and second paths to control bead size.

20. A method of sealing an insulating glass unit comprising:

providing a frame comprising a clamping arrangement for supporting a supported insulating glass unit in a fixed position during sealant dispensing, the clamping arraignment comprising a first clamp at a first end of the frame and a second clamp at a second end the frame, the first end at an opposite end relative to the second end, the supported insulating glass unit having first and second outwardly facing edges that meet at a corner of the insulating glass unit and have previously applied sealant in a region between two glass lites of the supported insulating glass unit;

connecting first and second dispensing assemblies to the frame via a slide arrangement for movement along prescribed portions of the first and second outwardly facing edges, the first and second dispensing assemblies coupled to first and second sensors, respectively;

positioning of the first and second dispensing assemblies at first and second initial positions;

applying additional sealant to the supported insulating glass units by dispensing sealant from the first and second dispensing assemblies into contact with the previously applied sealant to form a bead on the first and second outwardly facing edges of the insulating glass unit in a controlled manner while moving the first and second dispensing assemblies away from the first and second initial positions along the prescribed portions, utilizing feedback signals communicated independently to a controller by said first and second sensors; and sensing an amount of sealant accumulated on the outwardly facing edges utilizing the first and second sensors wherein the first and second sensors provide first and second signals related to accumulated sealant, wherein the first sensor monitors an amount of sealant dispensed from the first dispensing assembly and the second sensor monitors an amount of sealant dispensed from the second dispensing assembly and further wherein the movement of the dispensing assemblies or a rate at which sealant is dispensed from said dispensing assemblies is controlled based on said signals, further wherein the sensing an amount of sealant comprises generating a feedback loop based upon the feedback signals, said feedback loop independently controlling at least one of a speed and a pressure of the first and second dispensing assemblies, respectfully.

* * * * *